United States Patent [19]

Brownlow

[11] 4,240,271

[45] Dec. 23, 1980

[54] REFRIGERATED CIGARETTE PACK FACSIMILE

[76] Inventor: Susan E. Brownlow, 9776 Chestnut, Lakeside, Calif. 92040

[21] Appl. No.: 37,651

[22] Filed: May 11, 1979

[51] Int. Cl.[3] ..... F25D 3/08; F25D 3/10

[52] U.S. Cl. ..... 62/457; 62/371; 62/372; 62/529; 62/530; 206/259; 206/265; 206/266

[58] Field of Search ..... 62/457, 371, 372, 529, 62/530, 430; 206/259, 265, 266

[56] References Cited

U.S. PATENT DOCUMENTS

| | | | |
|---|---|---|---|
| 2,187,387 | 1/1940 | Trigg et al. | 62/457 X |
| 2,526,165 | 10/1950 | Smith | 62/530 X |
| 3,406,532 | 10/1968 | Rownd et al. | 62/457 |
| 3,662,915 | 5/1972 | Destler, Jr. | 220/265 |
| 3,859,819 | 1/1975 | Kaplan | 62/457 |
| 3,861,523 | 1/1975 | Fountain et al. | 220/259 |
| 4,182,405 | 1/1980 | Hysen et al. | 62/457 X |

*Primary Examiner*—Lloyd L. King

[57] ABSTRACT

A refrigerated box is provided in the shape of a cigarette box or pack having an upper container portion and a bottom which contains a heat sink material which is frozen in a home freezer and then plugged into the box to maintain the interior compartment refrigerated for the preservation and chilling of sticks of carrots, celery, and the like, to provide the person undergoing smoking withdrawal low-calorie snacks to munch on to substitute for cigarettes.

1 Claim, 3 Drawing Figures

REFRIGERATED CIGARETTE PACK FACSIMILE

BACKGROUND OF THE INVENTION

The cigarette smoking habit has three somewhat separate addictive characteristics. These are the chemical addiction to the nicotine drug, the somewhat related addiction to the feeling of the smoke in the respiratory system as it is inhaled, and third, the manipulative oral-digital physical habit associated with toying with the cigarette, constantly putting them to the lips, lighting matches, etc. When a smoker quits "cold turkey", he suffers withdrawals from all of these separate addictions. In other words, he feels sluggish, somtimes dizzy, and lacks concentration because of the absence of the drug nicotine; he is constantly distracted by the absence of the euphoric feeling of inhaling and thus becomes irritable, and he becomes very fidgity because of the absence of oral-digital stimulation provided physically by the cigarettes.

The present invention is intended to alleviate withdrawal associated with the third addiction, that is the purely physical aspect of manipulating the cigarettes, both in the hands and in the mouth. This, of course, is not a new idea in its broad sense and is quite familiar to anyone who has stopped smoking, attempted to stop, or knows someone who has gone through the withdrawals. Common methods of achieving the alleviation of this portion of the addiction are eating candy, eating anything, eating everything, chewing gum, chewing on an unlit pipe, munching on cloves or other non-nutritive spices, playing with unlit cigarettes, and so forth. Whereas different approaches work for different people, there is really no substitute for a cold, non-caloric, crunchy carrot stick or stick of celery.

SUMMARY OF THE INVENTION

The present invention is a means of providing the ex-smoker with access to cold carrot sticks and the like with the same convenience that he would have had reaching for a cigarette. The invention comprises a cigarette-shaped box that could be small enough to fit in the smoker's shirt pocket or purse and containing an adequate supply of carrot sticks and celery sticks to last the user several hours. The box is insulated to keep the vegetable sticks cold and a replaceable bottom plug contains a heat-absorbing material which would be frozen in a home freezer prior to use. In addition to the increased quality of preservation of food achieved by the refrigerated condition in which the carrot and celery sticks are kept, the coldness adds a significant degreee of oral stimulation without adding calories, so that by use of the box of the instant invention on a daily basis by an ex-smoker, withdrawal symptoms are relieved without causing a weight gain which is often coincident with recidivism.

DETAILED DESCRIPTION OF THE INVENTION

Figure 1:
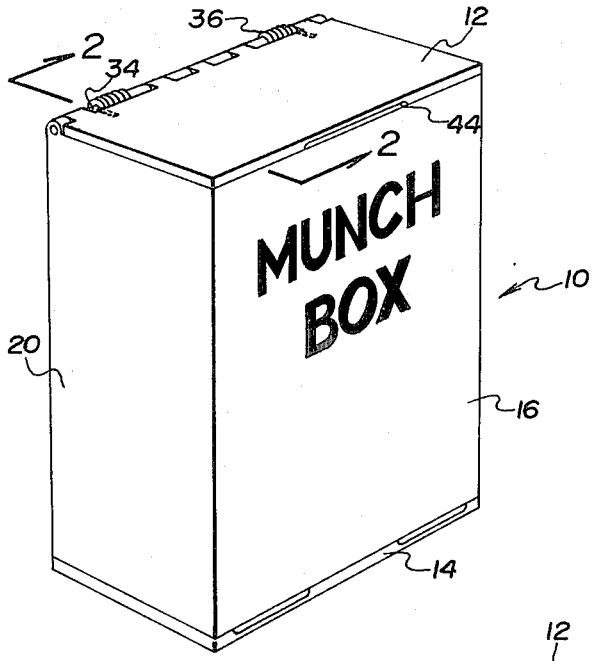
FIG. 1 is a perspective view of the invention in its closed position.
Figure 3:
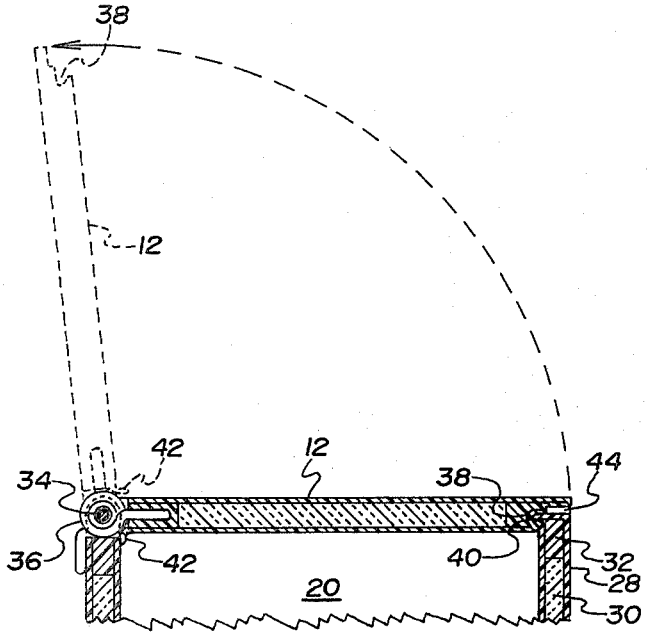
FIG. 3 is a vertical section similar to that of FIG. 2 showing the bottom plug in its inserted and removed positions.

The container is shown in FIG. 1 at 10 and comprises top panel 12, bottom panel 14, and four side panels including the front 16, the rear panel 18, and lateral walls 20. Together, these eight panels, which resemble in overall configuration a cigarette pack or box, define an interior compartment 22. This compartment is sufficiently large to contain a combination of cold, preferably non-caloric snacks such as carrot sticks 24 and celery sticks 26.

The shape of the container 10 as shown is somewhat plain, but it is conceivable that both the shape and the coloration and indicia be adapted to conform more closely to the precise shape and appearance of particular brands of cigarette packages and boxes.

Figure 2:
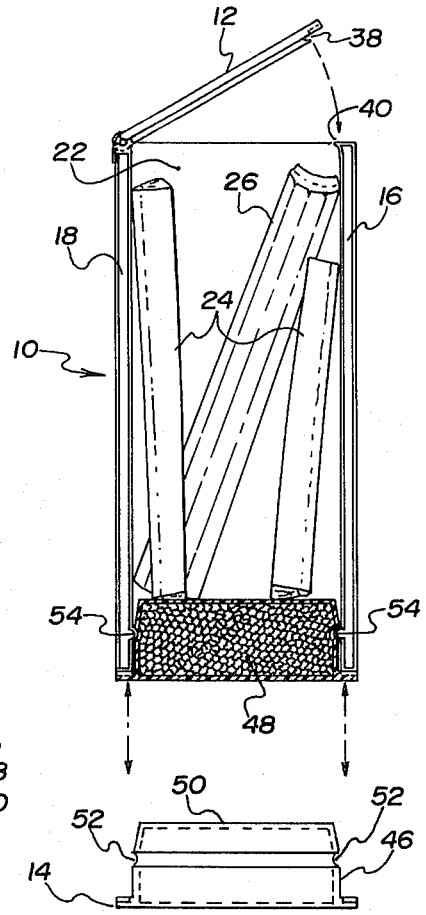
FIG. 2 is an enlarged section taken along line 2—2 of FIG. 1.

The panels, as best seen in FIG. 2, are made with an impermeable, probably plastic, outer skin 28 which sandwiches a layer 30 of insulation therebetween which is bordered by reinforcing frame members 32. Obviously, the exact thickness and thus effectiveness of the insulation is a trade-off against the available space for food or the bulkiness of the container.

It can also be seen from FIG. 2 that the lid 12 of the box is pivoted of hinged at 34 and is biased by springs 36 into the closed position. Once closed, detent 38 engages lip 40 as the lid snaps shut. Another lip 42 seals the lid at the edge adjacent the hinge. A fingernail slot is provided at 44 for convenient access to the internal compartment 22 of the box.

In order to keep the interior space of the box cool, it is necessary that the interior space be in conductive relation with a mass of heat sink material. This can be achieved in a number of ways, including expanding one of the sidewalls to incorporate this material, expanding the lid, or putting in a separate piece. However, an effective and convenient way used with the instant device is to incorporate an expanded bottom panel 14 which takes the form of a plug 46 containing the heat sink material 48. This plug is preferably provided at its top with a conductive skin 50 of metal or like heat conductor, and the sides are indented at 52 with a peripheral groove which is engaged by rib 58 on the interior surfaces of the sidewalls 16, 18 and 20.

Thus, the bottom plug 46 can be refrigerated in a freezer together with the remainder of the container, or separately, so that the container can be used all day until the material 48 is no longer effective and a replacement part fresh from the freezer can be used to insert in place of the warmed plug.

The unit as thus described has its primary application among those unfortunates who are trying to withdraw and terminate the cigarette habit, but other applications among dieters are clearly apparent.

It is the object of the invention as disclosed herein to provide a small, cigarette pack-sized box or pack having removable heat sink plug bottom and a hinged lid top, all walls being insulated, to provided in convenient and handy form, readily available, chilled, non-caloric snacks.

I claim:

1. A refrigerated cigarette box facsimile comprising:

(a) a vertically elongated container having the general shape of a flip-top cigarette box;

(b) said container having four thin, insulated side walls and a thin, insulated lid hinged to the top of one of said side walls and pivotal from an open position into a closed position snapped tightly into the tops of said four side walls;

(c) spring means biasing said lid into the closed position;

(d) a thickened hollow bottom plug filled with chillable heat sink material;

(e) detent means defined in the bottoms of said side walls and in said plug wherein said plug is snap-fitted between the bottoms of said side walls to define the bottom of said container, and removable to permit the insertion thereof into a freezer without requiring that the contents of the container be frozen;

(f) whereby a simulated cigarette box dimensioned to fit in a shirt pocket to replace a real cigarette box, and being bottom-heavy and stable in the pocket by virtue of the thickened heat-sink bottom, is provided.

* * * * *